US006393888B1

(12) United States Patent
Sautter et al.

(10) Patent No.: US 6,393,888 B1
(45) Date of Patent: May 28, 2002

(54) SPRING WINDING DEVICE, PARTICULARLY FOR SPRING WINDING MACHINES

(75) Inventors: Dietmar Sautter, Lichtenstein; Karl-Heinz Fritz, Metzingen; Joachim Baerman, Reutlingen-Ohmenhausen; Franz Decker, Lichtenstein, all of (DE)

(73) Assignee: Wafios Aktiengesellschaft, Reutlingen (DE)

( * ) Notice: Subject to any disclaimer, the term of this patent is extended or adjusted under 35 U.S.C. 154(b) by 0 days.

(21) Appl. No.: 09/558,315

(22) Filed: Apr. 25, 2000

(30) Foreign Application Priority Data

Apr. 30, 1999 (DE) ..... 199 19 956

(51) Int. Cl.[7] ..... B21F 3/02
(52) U.S. Cl. ..... 72/140; 72/138
(58) Field of Search ..... 72/135, 138, 140

(56) References Cited

U.S. PATENT DOCUMENTS 3,934,445 A * 1/1976 Lampietti ..... 72/140
4,872,854 A * 10/1989 Russell et al. ..... 72/138

FOREIGN PATENT DOCUMENTS

| | | |
|---|---|---|
| DE | 896 186 | 7/1949 |
| DE | 23 10 174 | 9/1974 |
| DE | 95 13 164 | 2/1993 |
| DE | 198 25 970 | 12/1998 |

OTHER PUBLICATIONS

*English Abstract of DE 896 186.
*English Abstract of DE 23 10 174.
*English Abstract of DE 95 13 164.
*English Abstract of DE 198 25 970.

* cited by examiner

*Primary Examiner*—Lowell A. Larson
(74) *Attorney, Agent, or Firm*—Reed Smith LLP

(57) ABSTRACT

In a spring winding device for producing right-hand or left-hand helical springs from wire, with pull-in rollers, a wire guide and two winding apparatuses, each of which has a slide guide body with a slide displaceably arranged therein, every slide guide body is swivelable at its end remote of the wire guide around a swiveling axis directed vertical to the wire guide axis. The two winding apparatuses lie on different sides of the center plane, with a drive for the movement of the slide and a cam drive controlled by a cam disk for swiveling the slide guide body. A shared cam disk with two control portions and at least one rest portion is allocated to the two cam drives. Each control portion serves to introduce controlling movements in one of the two cam drives, while the rest portion, or every rest portion, does not introduce any controlling movements in the cam drive. By rotation of the cam disk, a control portion is connected to the associated cam drive, while the other cam drive contacts the rest portion, wherein the controlled cam drive cooperates in a program-controlled manner with the drive unit for the movement of one of the slides, while the drive unit of the other slide is switched off.

9 Claims, 6 Drawing Sheets

SPRING WINDING DEVICE, PARTICULARLY FOR SPRING WINDING MACHINES

BACKGROUND OF THE INVENTION a) Field of the Invention

The invention is directed to a spring winding device, particularly for spring winding machines, for producing, selectively, right-hand-wound or left-hand-wound helical springs from wire.

b) Description of the Related Art

A known spring coiling or spring winding device for spring winding machines (DE-PS 896 186) uses two winding tools which are arranged on slides and coupled together so as to be fixed with respect to movement by a level indirectly controlled by a cam disk. For this purpose, one slide is arranged on one side of the wire guide and the other slide is arranged on the other side of the wire guide, both slides being guided in a linear manner on a tool plate common to both. However, to switch this known device in order to generate springs with a different winding direction, it is necessary to replace the existing winding apparatus with a different winding apparatus because different spring winding devices must be used for springs with different winding directions.

In another known spring winding machine (DE-OS 23 10 174), two winding apparatuses are provided, each with a winding tool; the winding tool in the winding apparatus in question can be advanced linearly toward the exit location of the wire at the wire guide by means of a carriage or slide and a slide guide. In addition, each of the two winding apparatuses is arranged so as to be swivelable about a bearing axis which extends transverse to the axis of the wire guide and which is located at the end portion of the slide guide body remote of the wire guide. This known spring winding device allows every tool to be moved linearly and swiveled simultaneously, so that it can be used in the function of an inner winding tool as well as an outer winding tool. In this case, while it is possible to switch the winding direction without having to change the entire winding apparatus, it is impossible to produce shaped springs with this known device because no controlling means are provided for displacing the two winding tools relative to one another during the manufacturing of the spring.

A winding device which cannot be used for producing selectively right-hand helical springs or left-hand helical springs, but which is suitable for simultaneously generating noncylindrically shaped helical springs also is described in DE-GM 92 13 164. In this case, again, two winding apparatuses are used, each having a slide guide body in which a slide is displaceably arranged in such a way that a winding tool connected with the slide is guided so as to be moveable linearly relative to the point at which the wire exits the wire guide. Every slide guide body is swivelable at its end region remote of the wire guide around a swiveling axis directed vertical to the wire guide axis and parallel to a center plane extending through the wire guide axis, the two winding apparatuses being arranged on different sides of this center plane. A suitable cam drive is associated with each of the two winding apparatuses; in one winding apparatus, the cam drive pushes the slide back and forth in its guide, while in the other winding apparatus the cam drive swivels the slide guide body back and forth, and both movements are program-controlled relative to one another. However, switching the winding direction for the helical springs to be produced in this known winding device requires that a number of mechanical conversions be carried out, and it is necessary in particular to change the kinematic drive between the cam disk and winding apparatus and to change devices at the winding apparatuses themselves, which is still relatively time-consuming and complicated.

DE-OS 198 25 970 discloses a spring manufacturing arrangement using two tool units, each of which is fastened to a plate which is arranged so as to be movable in the wire guide direction to another plate which can, in turn, be moved vertical to the wire guide direction. Accordingly, each tool unit can be moved independently from the other in two coordinate directions extending perpendicular to one another, which allows the tip of the tool carried by the tool unit to move to any desired point. In this known device, it is possible to switch the spring winding direction without carrying out significant conversion arrangements essentially by switching the program control. However, this known spring winding device necessitates the use of four independently working servo motors and a plurality of individual elements which are arranged on and movable relative to one another, which represents a very great expenditure.

OBJECT AND SUMMARY OF THE INVENTION

On this basis, it is the primary object of the invention to provide a spring winding device of the type mentioned above in which it is possible to switch the winding direction of the generated springs while substantially avoiding mechanical conversion operations and which nevertheless has a relatively simple construction.

According to the invention, this object is met by a spring winding device, in particular for spring winding machines, for producing, selectively, right-hand or left-hand helical springs from wire, with pull-in rollers for transporting the wire along a wire guide axis through a wire guide, with two winding apparatuses, each of which has a slide guide body in which a slide is displaceably arranged in such a way that a winding tool connected with the slide is guided so as to be moveable linearly relative to the point at which the wire exits the wire guide, wherein every slide guide body is swivelable at its end region remote of the wire guide around a swiveling axis directed vertical to the wire guide axis and parallel to a center plane extending through the wire guide axis, the two winding apparatuses being arranged on different sides of this center plane, wherein a drive for the movement of the slide and a cam drive controlled by a cam disk for swiveling the slide guide body about the swiveling axis are allocated to each winding apparatus, wherein a shared cam disk which is swivelable by a program-controlled motor and has two control portions and at least one rest portion is allocated to the cam drives of both winding apparatuses, wherein, further, each control portion is configured for introducing controlling movements in one of the two cam drives and every rest portion is configured for introducing no controlling movements in the cam drive, and, by rotation of the cam disk, one of the control portions for producing helical springs in one winding direction can be connected to the associated cam drive for control thereof, while the other cam drive contacts the rest portion or one of the rest portions, and wherein the controlled cam drive cooperates in a program-controlled manner with the drive unit for the movement of one of the slides, while the drive unit of the other slide is deactivated.

As a result of the mechanical movability of every tool holder in two movement directions which is provided in the spring winding device according to the invention, it is possible to produce non-round springs, time spent on adjustment is reduced, the reproducibility of adjustments is ensured, and the initial winding of the springs can be effected automatically for the first turn without manual effort. Through the use of a cam disk which is shared by both cam drives and which need only be rotated at a certain angle for connecting to one cam drive or the other, the conversion work for switching from right-handed winding to left-handed winding is minimized because it is necessary only to carry out the individual tool adjustments at the tool holder.

Further, the spring winding device according to the invention also provides greater rigidity of the overall arrangement through a more favorable flux of force and increased expenditure for assembly and maintenance for belt drives, as required in DE-GM 92 13 164, is done away with. It is also possible in the spring winding machine according to the invention to achieve a constant loading torque over the entire spring diameter range (with the identical wire diameter and with respect to the shaping forces) by using a specially calculated cam rule.

As a result of the cam disk which is used in the invention and shared by the two cam drives, it is also necessary to provide only three servo motors and accordingly to cover the overall basic principle of spring winding with three axes. In this way, all of the advantages are achieved merely through the use of a third motor without the need for another motor as is the case in the known spring winding device according to DE-OS 198 25 970. In addition, it is also possible to do away with the complicated arrangement—likewise employed in the prior art—of carrying tables for tool carrying devices which are arranged one above the other and which are movable relative to one another in different directions and the likewise rather complicated connection mechanism on one table which is required during the movement of a second table for the movement of two additional tables.

The individual motors for the drive unit for the common cam disk and for the two drive units for moving the slides are coupled with one another via an electronic program control which ensures that the motors which are used for the winding of springs in one winding direction exactly carry out the movements required for the production of the desired spring shape in a program-controlled manner.

In an advantageous arrangement of the invention, the cam drive of a winding apparatus cooperates in a program-controlled manner with the drive unit for the movement of the slide of the other winding apparatus, so that helical springs of one winding direction can be produced in the two-finger system. If springs are to be produced in the other winding direction, the cam drive of the other winding apparatus is correspondingly connected with the other drive for the linear movement of the slide.

When the spring winding device according to the invention is used for the shaping process in the case of forward feed of the wire in the one-finger system, the cam drive of a winding apparatus is preferably coupled in a program-controlled manner with the drive unit for the movement of the slide of the same winding apparatus, i.e., one winding apparatus is in use, while the other winding apparatus is deactivated.

If helical springs with a different winding direction are to be produced in the one-finger winding system, the cam drive of the other winding apparatus is preferably coupled in a program-controlled manner with the drive unit for the movement of the slide in this winding apparatus.

In the spring winding device according to the invention, any suitable type of drive can be used in principle as a drive unit for the movement of the slide in each winding apparatus. However, it is especially preferable when a cam disk which is rotatable by a program-controlled motor is provided as a drive unit for the movement of the slide in each winding apparatus, wherein the cam movement of the rotatable cam disk is transmitted in a positively controlled manner to the slide. This allows for the great advantage that the occurring weight forces and acceleration forces do not impair the accuracy of the traveling movements of the slide or tool holder due to the positive guidance.

In a particularly preferred manner, the axis of rotation of the cam disk common to the two cam drives is arranged in the spring winding device according to the invention in such a way that it intersects the projection of the wire guide axis at right angles and, in so doing, lies in the center plane. Accordingly, a mirror-symmetric arrangement of the cam drives on both sides of the center plane can be achieved, which leads to identical loading on the switched-on cam drives in both spring winding directions.

The winding apparatuses are also preferably arranged in a mirror-symmetric manner to the wire guide axis in a spring winding device according to the invention, wherein they are preferably constructed in a mirror-symmetric manner relative to one another.

In another preferred construction of the invention, a guide plate is arranged between the winding apparatuses symmetric to the wire guide axis in the projection thereof and at a distance from the wire exit point, which guide plate has a guide path on its two sides facing the winding apparatuses, the facing end of the slide guide body of the winding apparatus in question sliding on this guide path.

The invention will be described by way of example hereinafter with reference to the drawings.

DESCRIPTION OF THE PREFERRED EMBODIMENTS

Figure 1:
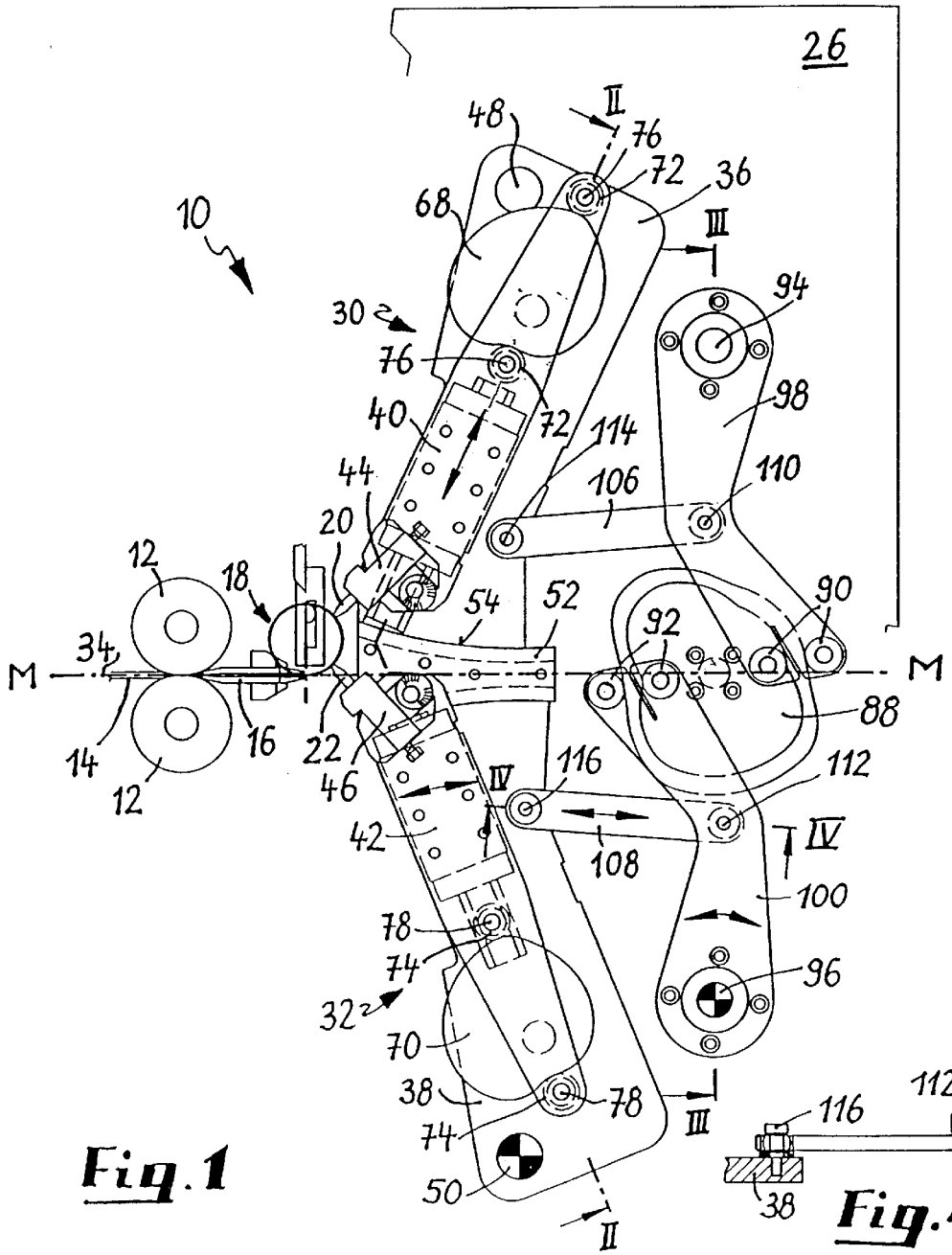
FIG. 1 shows a schematic front view of a spring winding device according to the invention configured for the production of right-hand helical springs in the two-finger winding system.
Figure 4:
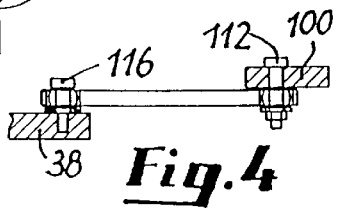
FIG. 4 shows la section corresponding to line IV—IV through a detail in FIG. 1.

The spring winding device 10, details of whose construction are shown by way of example in the Figures, is part of a spring winding machine (not shown) with pull-in rollers 12 which are driven by a CNC-controllable servo motor, not shown, and which pull a wire 14 in a straight line horizontally through a wire guide 16 into a winding station 18 in which, depending on the position of the two winding tools 20 and 22, the wire 14 is shaped into right-hand or left-hand helical springs by two winding tools 20 and 22 which are constructed as winding fingers of two winding apparatuses 30 and 32 which are fastened one above the other to a winding plate 26 of the spring winding machine; that is, depending on whether a right-hand helical spring or a left-hand helical spring is to be produced, the wire 14 is deflected upward or downward with reference to the wire guide axis 34.

Each of the two winding apparatuses 30 and 32 arranged above and below the wire guide axis 34, respectively, and a center plane M—M extending through the latter is formed of a slide guide body 36 and 38, respectively, on which a slide 40, 42 is guided so as to be longitudinally displaceable by means of a commercially available linear guide unit 43 whose guide rail is fastened to the slide guide bodies 36 and 38 and whose guide carriages are fastened to the slides 40 and 42. Each of the slides 40, 42 carries, at its end facing the wire guide 16, a holder 44 and 46, respectively, which is swivelably fastened therein and in which the upper winding tool 22 and the lower winding tool 24 is fastened.

Each of the two slide guide bodies 36 and 38 is swivelably mounted at its end area remote of the winding tool 22, 24 on an axle which is constructed as a fixed pin 48, 50 at the winding plate 26. The end of each slide guide body 36 or 38 close to the tool is rounded with a radius of the axis of the pin 48, 50. Both slide guide bodies 36 and 38 lie with these ends at a coplanar guide plate 52 with lateral paths 54 of a correspondingly constructed contour which is concave on both sides, these paths 54 facing the slide guide bodies 36 and 38.

Figure 2:
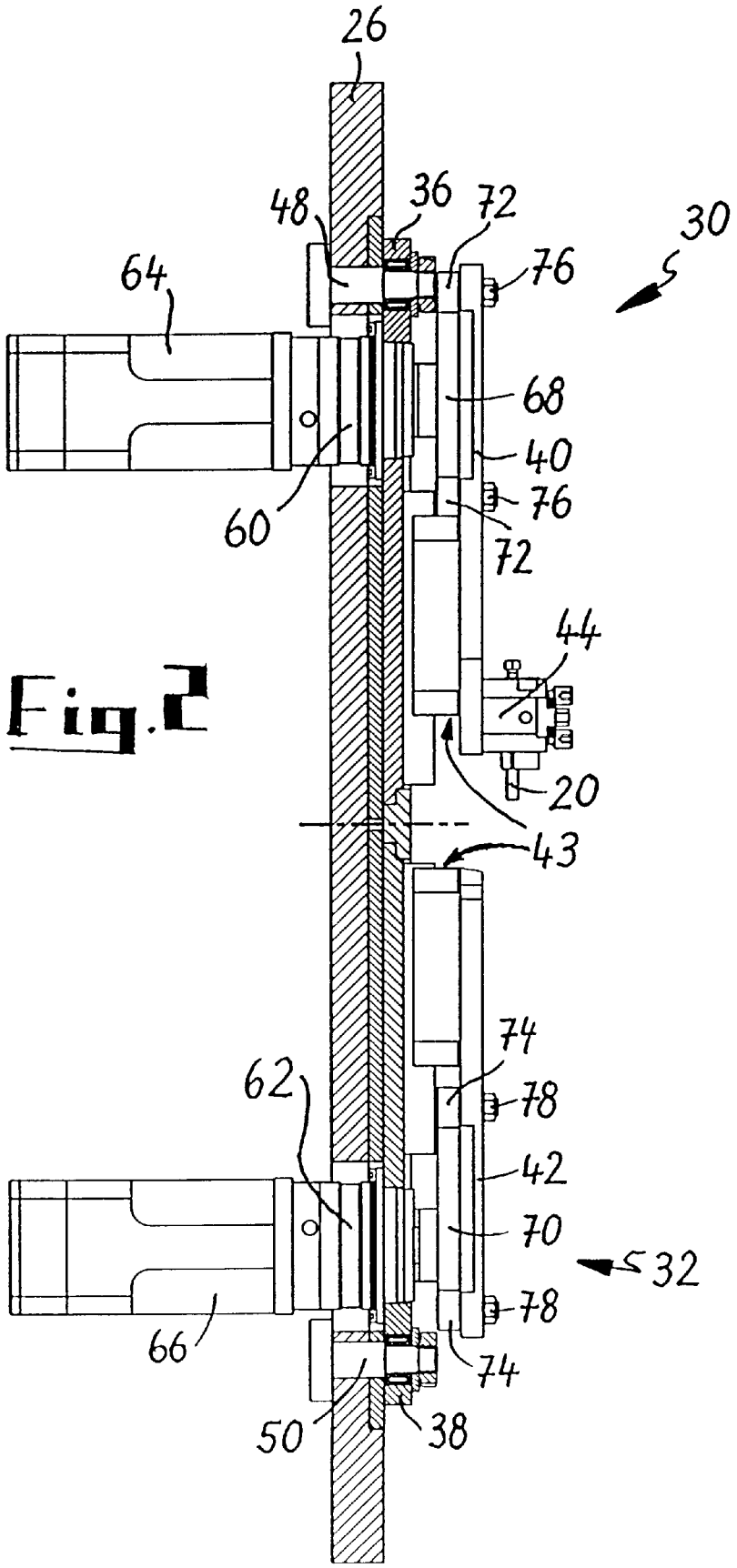
FIG. 2 shows a vertical longitudinal section corresponding to line II—II in FIG. 1.

As can be seen from the sectional view in FIG. 2, a gear unit 60, 62 is fastened in a receiving bore hole in the end region of the slide guide bodies 36 and 38 which faces away from the wire guide axis 34; a program-controlled servo motor 64, 66 rotating back and forth intermittently is flanged on to one side of the gear unit 60, 62. A control cam 68 and 70 is connected with the drive shafts of the two gear units 60 and 62 so as to be fixed with respect to rotation relative thereto in each instance. Two rollers 72, 74 run along the control cams 68, 70 and are arranged so as to be rotatable (FIG. 2) on a pin 76, 78 fastened to the upper slide 40 and lower slide 42, respectively, so that the movement of the slides 40 and 42 is positively guided through the rotating movement of the control cams 68 and 70.

In extension of the wire guide axis 34, another gear unit 84 is flanged on in the winding plate 26 of the spring winding machine in a stepped receiving bore hole which is vertical to the wire guide axis 34, runs through the latter with its center axis and lies in the center plane M—M. Another CNC-regulated servo motor 86 which rotates back and forth intermittently is arranged at the input of this further gear unit 84. On the output side, a disk-shaped control cam 88 constructed as a bead cam is arranged at the gear unit 84 so as to be fixed with respect to rotation relative to it. Two rollers 90, 92 run along the control cam 88 in a positively guided manner. These two rollers 90 and 92 are arranged so as to be rotatable at an angular one-arm lever 98, 100 which is needle-mounted in a swivelable manner on a pin 94 and 96 fastened to the winding plate 26 of the machine. The two pins 94, 96 are arranged one above the other (FIG. 3) on different sides of the drive shaft of the gear unit 84 and at the same distance therefrom vertical to the wire guide axis 34.

A coupling joint rod 106 and 108 is articulated by pins 110 and 112 approximately in the middle of the lever 98, 100 on one side and via pins 114 and 116 at the slide guide body 36 of the upper winding apparatus 30 or at the slide guide body 38 of the lower winding apparatus 32 on the other side.

In the following, the manner of operation of the spring winding device shown herein for producing right-hand helical springs in the two-finger winding system will be described with reference to the FIGS. 1 to 4.

For the shaping drive of the winding tool 20 of the upper winding apparatus 30 for adjusting the outer diameter of the spring during its manufacture, the servo motor 64 is activated and drives the control cam 68 in forward and backward rotation intermittently in a program-controlled manner via the gear unit 60. The radial movement of the control cam 68 is transmitted via the rollers 72 to the slide 40 of the upper winding apparatus 30 and the upper winding tool 20 is moved linearly back and forth in a nearer/forward or farther away/rearward inclined position relative to the outlet point of the wire 14 at the wire guide 16.

The movement of the winding tool 22 of the lower winding apparatus 32, which movement is adapted to the movement of the upper winding tool 20 based on rules, is given in a program-controlled manner by the control cam 88 which is driven correspondingly by the servo motor 86 via the gear unit 84. The movement of the control cam 88 is transmitted via the rollers 92 to the swivelable lever 100 and, further, via the coupling joint rod 108, to the lower slide guide body 38. In this way, the slide guide body 38 with the winding tool 22 of the lower winding apparatus 32 executes a positively controlled reciprocating swiveling movement around the axis of the pin 50 as the center of swiveling. The lower winding tool 22 is accordingly likewise moved into a front and a rear position in relation to the outlet point of the wire at the wire guide 16 by means of the cam drive 88, 92 and 100.

The winding tools 20, 22 of the upper and lower winding apparatuses 30, 32 are (at least predominantly) simultaneously displaced according to laws defined by design. The cam laws of the two control cams 68 and 88 which are specifically calculated beforehand are used for this purpose in conjunction with the two program-controlled servo motors 64 and 86 which rotate forward and backward intermittently.

It should be noted that the control cam 88 apart from two control portions designed for the introduction of control movements in one or the other of the two cam drives is provided along certain areas of its circumference with two rest portions, i.e., no controlling movement to the transmission members is carried out along this rotational area of the cam path of the control cam 88. In the case of right-hand winding of a helical spring, the rest portion of the control cam 88 is responsible for or active for the upper winding apparatus 30 which accordingly, in this case, does not carry out a swiveling movement about the pin 48.

Further, the upper winding apparatus 30 is rigidly secured via the cam roller 90, the lever 98 and the coupling joint rod 102 and its connection pins 110 and 114.

Further, it is noted that the CNC-controllable servo motor 66 of the lower winding apparatus 32 is switched off in a program-controlled manner during right-hand winding. However, it can be used for automatic initial bending of the first wire turn by the lower winding tool 22.

Figure 5:
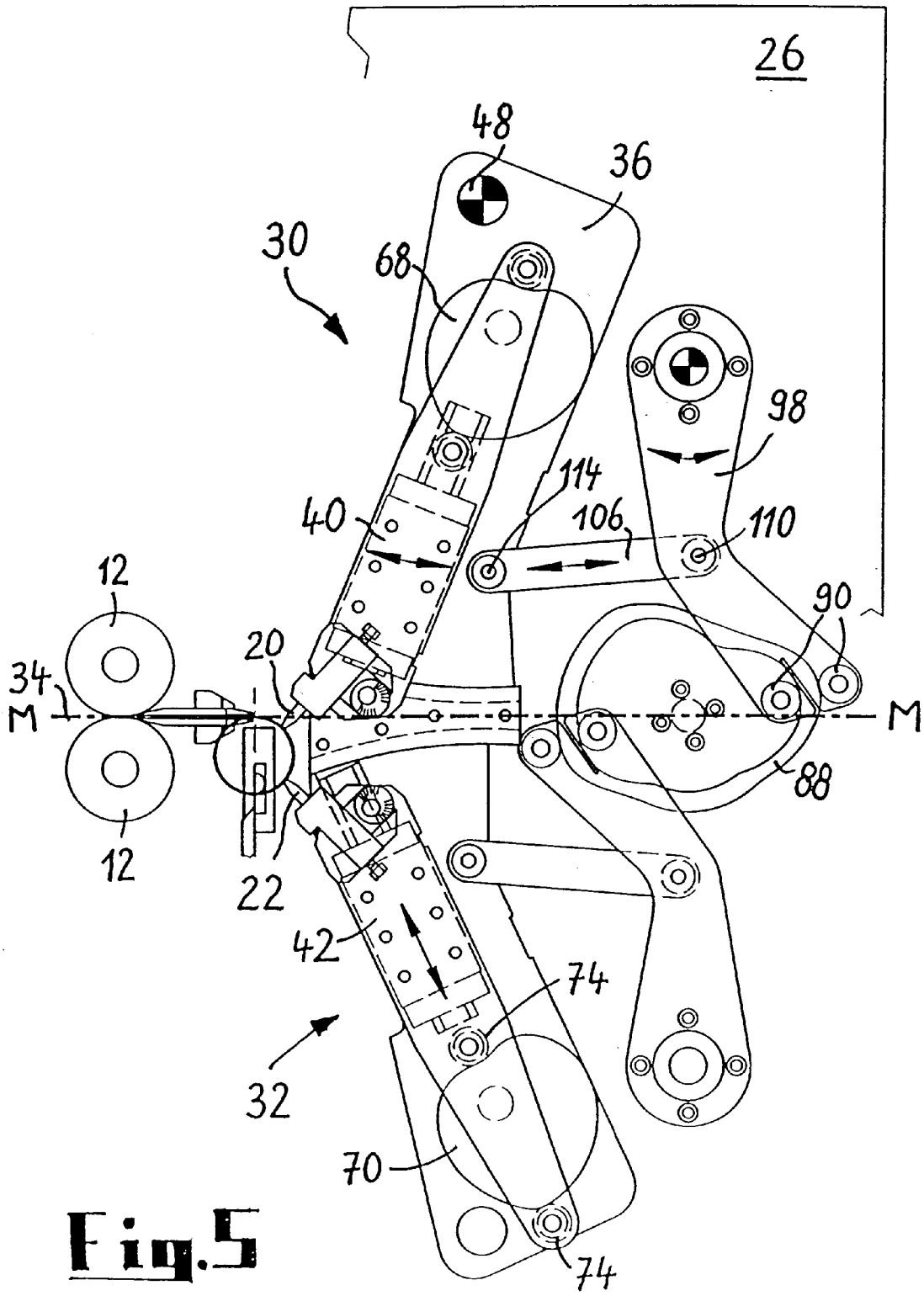
FIG. 5 shows the spring winding device from FIG. 1, directed to the production of left-hand helical springs.

The switching of the two winding apparatuses 30 and 32 from one winding direction to the other winding direction, e.g., from the right-hand winding shown in FIG. 1 to the arrangement for left-hand winding shown in FIG. 5, is carried out proceeding from the machine control without any additional conversion effort (apart from the switching of the cut-off mandrel and cutting tool of the machine).

In this respect, after inputting the left-hand winding command, the servo motors 64 and 66 move the upper and lower winding tool 20 and 22, respectively, into their rear-most position which is drawn back farthest from the wire guide 16, while servo motor 86 subsequently rotates the control cam 88 farther until the rest portion of the control cam 88 is active for the lower winding apparatus 32. The subsequent adjustment of the starting diameter of a shaped spring or outer diameter of a cylindrical helical spring is then carried out by switching on both servo motors 64 and 66 which displace the winding tools 22 and 24 relative to one another to the required degree as governed by rules. Subsequently, the drive motor 64 of the upper winding apparatus 30 is switched off and used for automatic initial bending of the wire of the first spring turn through the upper winding tool 20. The matched movement of the winding tool 20 of the upper winding apparatus 30 required for producing a left-hand shaped spring is carried out via the control cam 88 driven by the servo motor 86. The movement of the control cam 88 is now transmitted via the two rollers 90 to the swivelable lever 98 and further via the coupling joint rod 106 and via pins 110 and 114 to the upper slide guide body 36 which accordingly swivels back and forth around the axis of pin 48 as the center of swiveling and therefore moves the winding tool 20.

The linear movement of the lower winding tool 22 is carried out by the control cam 70 driven by the servo motor 66 via the rollers 74 and the slide 42.

The winding tool 20 of the upper winding apparatus 30 now serves, during the production of left-hand spring bodies, as an inner tool and the winding tool 22 of the inner winding apparatus 32 serves as an outer winding tool; while the upper tool 20 serves as an outer winding tool for right-hand helical springs and the lower tool 22 serves as an inner winding tool (wherein "inner" and "outer" are used in accordance with the terminology reproduced in DE-OS 2 310 174).

Figure 6:
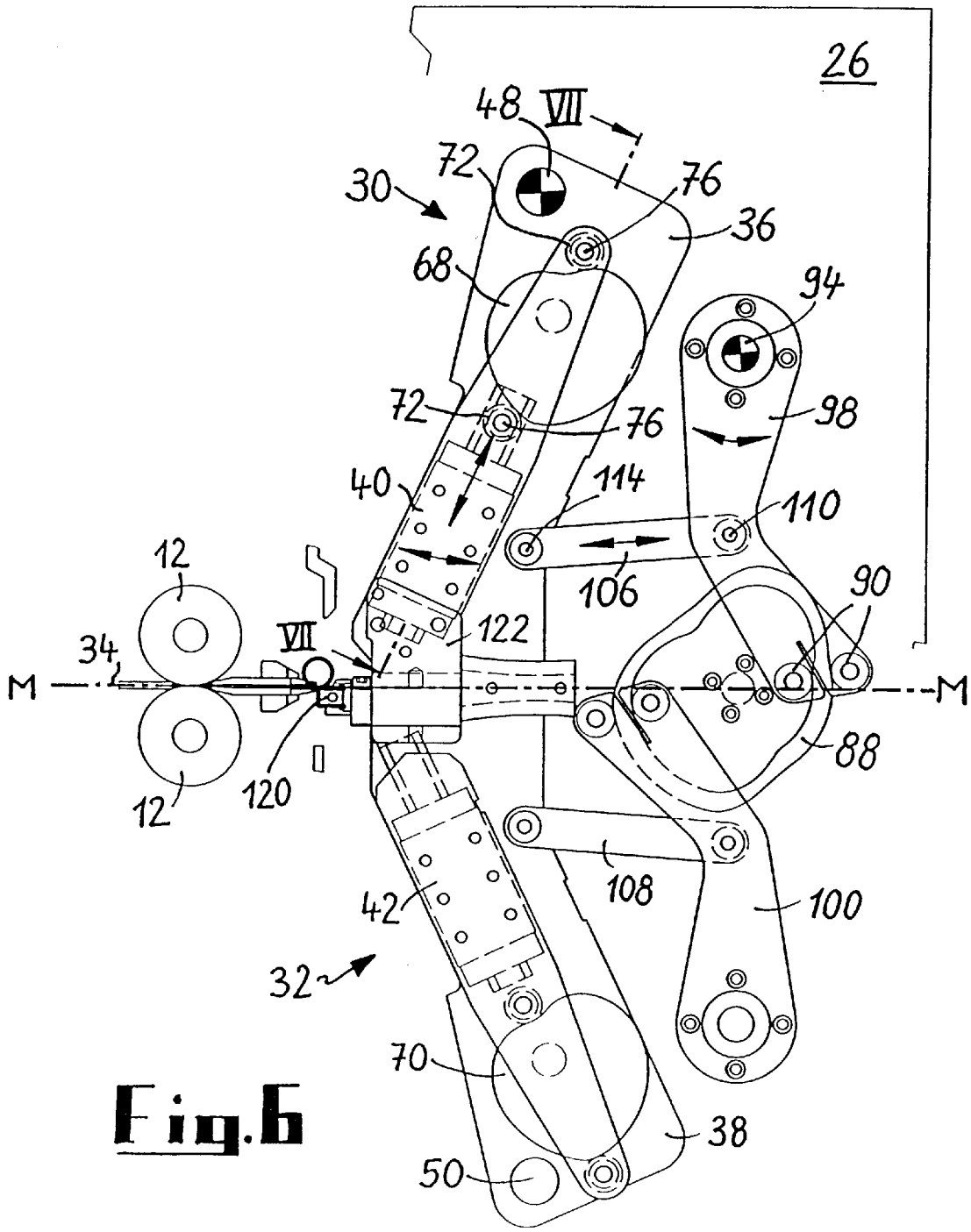
FIG. 6 shows a view of the spring winding device according to FIG. 1, but arranged for the production of right-hand helical springs in the one-finger winding system.
Figure 7:
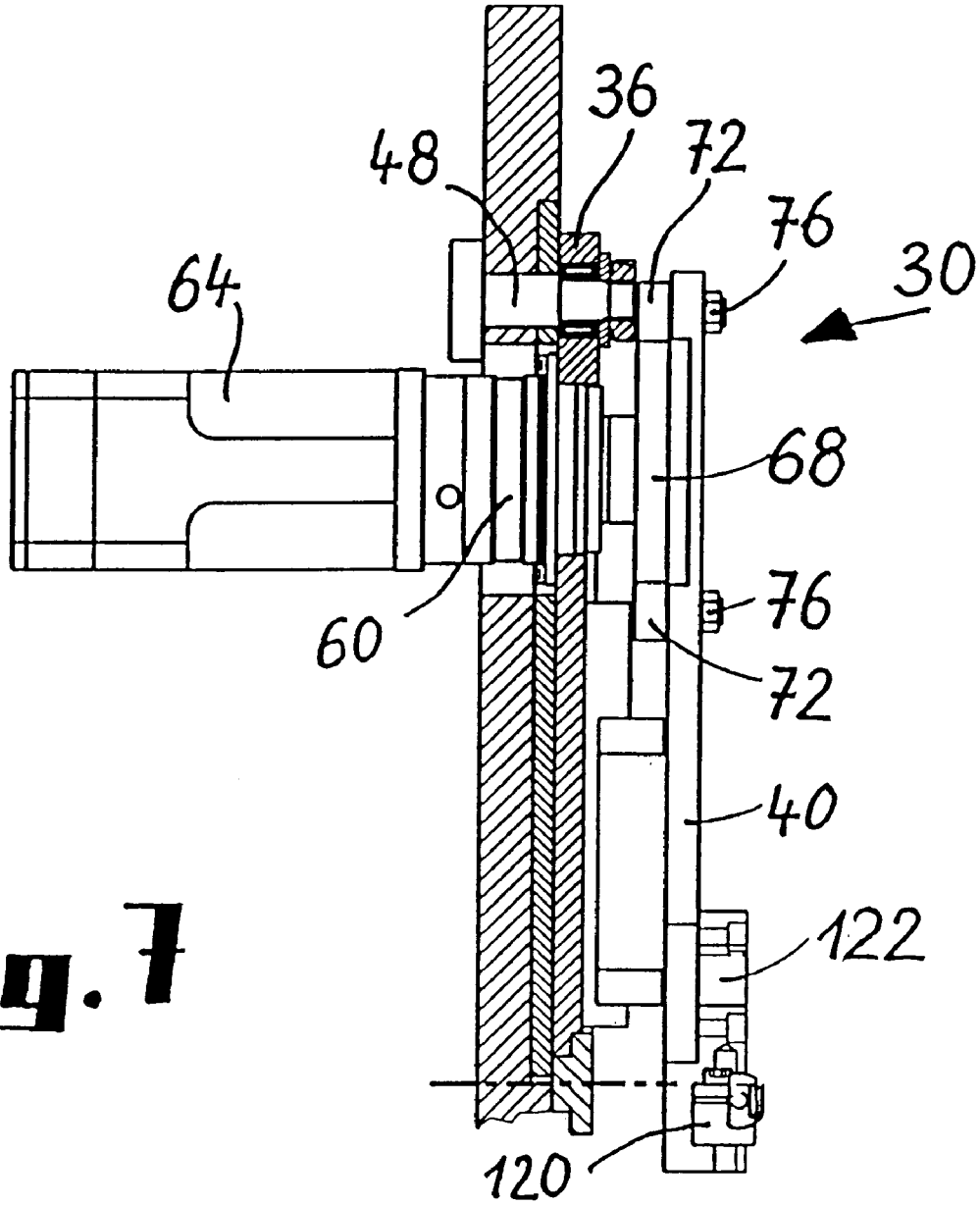
FIG. 7 shows a section corresponding to line VII—VII through the upper winding apparatus of the spring winding device shown in FIG. 6.

FIGS. 6 and 7 show the spring winding device for producing right-hand helical springs in the one-finger winding system.

In this one-finger winding device, the mechanical movement of the winding tool 120, of which there is only one in this case, in two movement directions is described more exactly in the following with reference to FIGS. 1 to 7.

Figure 3:
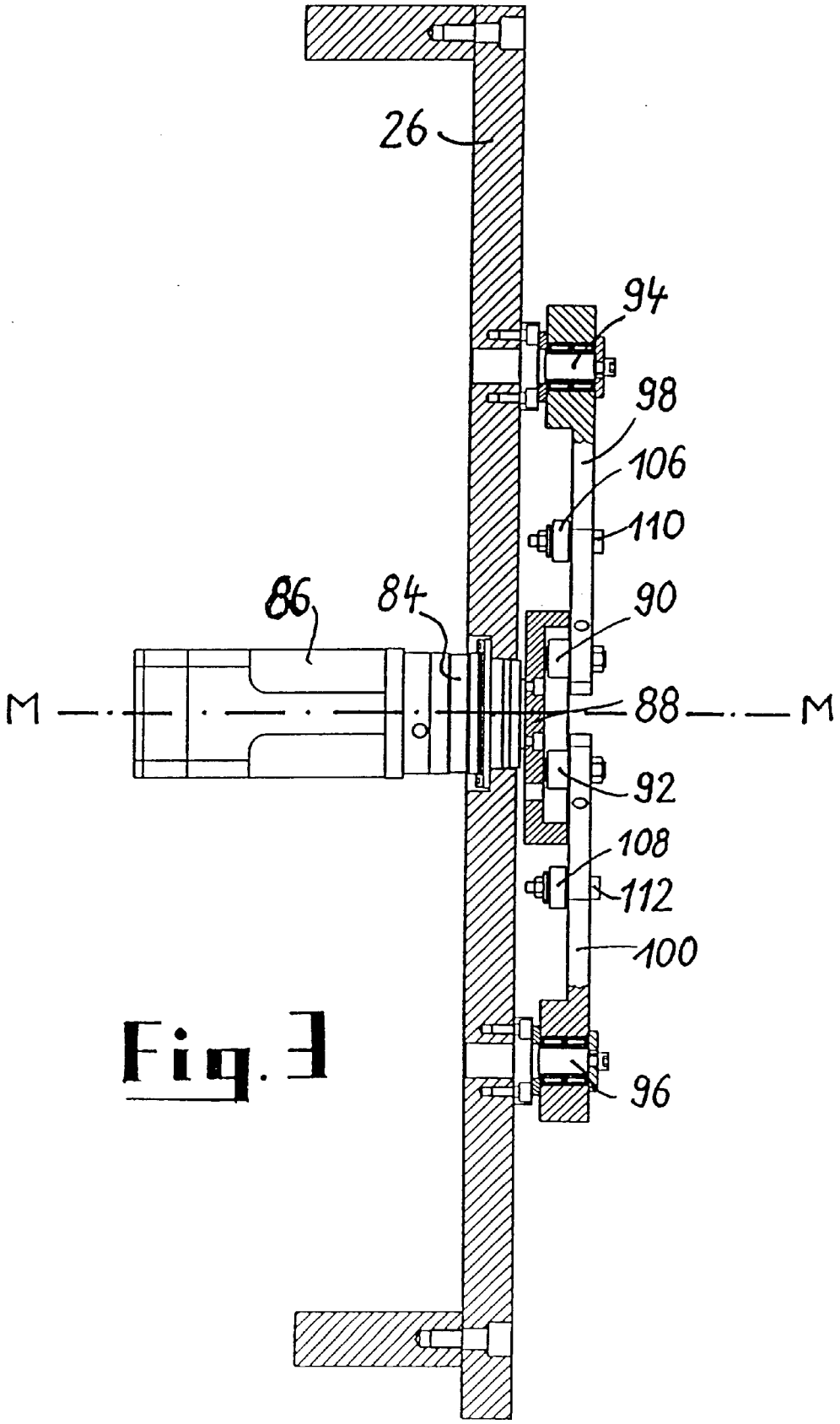
FIG. 3 shows a vertical longitudinal section corresponding to line III—III through the swivel drive of the spring winding device shown n FIG. 1.

The individual winding tool 120 is fastened to a holder 122 at the slide 40 of the upper winding apparatus 30, wherein the slide 40 is positively guided in reciprocating manner via a cam disk 68 and rollers 72 fitting on pins 76. The cam disk 68 itself is driven by the program-controlled servo motor 64 (FIG. 7) intermittently in forward and backward rotation via the gear unit 60. At the same time that this linear and diagonally directed movement takes place, a program-controlled swiveling movement of the upper slide guide body 36 is carried out (or can be carried out) about the axis of pin 48 as center of swiveling. This swiveling movement is transmitted by a CNC-controllable servo motor 86 via a gear unit 84 to a control cam 88 (as is shown in FIG. 3) and is transmitted from there via two rollers 90 in a positive-controlled manner to the lever 98 which is swivelable on pins 94 and further via a coupling Joint rod 106 via pins 110 and 114 to a slide guide body 36 of the upper winding apparatus 30.

The slide 42 of the lower winding apparatus 32, which in this case is inactive for production and whose winding tool holder is removed, has been moved via the servo motor 66 (as in FIG. ) and control cam 70 into its pulled-back, rear position.

The effective or acting surface of the winding tool 120 can travel through every required movement path by means of the above-described controlled straight-line movement of the winding tool 120 via the slide 40 which, however, interacts with the controlled swiveling movement of the slide guide body 36.

In order to produce left-hand helical springs in the one-finger winding system, the lower winding apparatus 32 is used, while the upper winding apparatus 30 is deactivated. The straight-line movement of the winding tool, not shown, is now carried out proceeding from the servo motor 66 via the cam disk 70 and the swiveling movement of the lower slide guide body 38 is carried out around the pin 50 proceeding from the servo motor 86, which had previously rotated the control cam 88 until its rest area is now responsible for the upper inactive winding apparatus 30, via this control cam 88 to the lever 100 and from there via the coupling joint rod 108 to the slide guide body 38.

In principle, left-hand helical springs can also be produced with the winding tool 120 of the upper winding apparatus 30. For this purpose, it is only required that the winding apparatus 30 is moved upward by the servo motor 64 until the winding tool 120 now acts on the wire 14 on the other side, that is, above the wire guide axis 34, so as to work downward, while, for the previously right-hand helical springs the winding tool 120 acted on the wire 14 below the wire guide axis 34 and moved upward.

As can be seen from FIGS. 1, 5 and 6, the two winding apparatuses 30 and 32 are arranged at the winding plate 26 in a mirror-symmetric manner to the wire guide axis 34 and are constructed so as to be mirror symmetric relative to one another.

In all of the winding processes described above, non-round helical springs can also be produced by separate control of the winding tools; it is also possible to wind spring shapes which have different winding radii within a spring winding.

While the foregoing description and drawings represent the preferred embodiments of the present invention, it will be obvious to those skilled in the art that various changes and modifications may be made therein without departing from the true spirit and scope of the present invention.

What is claimed is:

1. A spring winding device, particularly for spring winding machines, for producing, selectively, right-hand or left-hand helical springs from wire comprising:

pull-in rollers for transporting the wire along a wire guide axis through a wire guide;

two winding apparatuses, each of which having a slide guide body in which a slide is displaceably arranged in such a way that a winding tool connected with the slide is guided so as to be moveable linearly relative to a point at which the wire exits the wire guide;

said slide guide body being swivelable at an end region remote of the wire guide around a swiveling axis directed vertically to the wire guide axis and parallel to a center plane extending through the wire guide axis;

said two winding apparatuses being arranged on different sides of said center plane;

a drive for the movement of the slide and a cam drive controlled by a cam disk for swiveling the slide guide body about the swiveling axis are allocated to each winding apparatus;

a shared cam disk which is swivelable by a program-controlled motor and having two control portions and at least one rest portion is allocated to the cam drives of both winding apparatuses;

each control portion being configured for introducing controlling movements in one of the two cam drives and rest portions being configured for introducing no controlling movements in the shared cam drive, and, by rotation of the cam disk, one of the control portions for producing helical springs in one winding direction can be connected to the associated cam drive for control thereof, while the other cam drive contacts the rest portions or one of the rest portions; and said controlled cam drive cooperating in a program-controlled manner with the drive unit for the movement of one of the slides, while the drive unit of the other slide is switched off.

2. The spring winding device according to claim 1, wherein the cam drive of a winding apparatus cooperates in a program-controlled manner with the drive unit for the movement of the slide of the other winding apparatus.

3. The spring winding device according to claim 1, wherein a cam disk which is rotatable by a program-controlled motor is provided as a drive unit for the movement of the slide in every winding apparatus.

4. The spring winding device according to claim 3, wherein the slide of every winding apparatus is positively guided at the rotatable cam disk.

5. The spring winding device according to claim 1, wherein the axis of rotation of the cam disk common to the two cam drives lies in the projection of the wire guide axis.

6. The spring winding device according to claim 1, wherein the cam drive of a winding apparatus cooperates in a program-controlled manner with the drive unit for the movement of the slide of the same winding apparatus.

7. The spring winding device according to claim 1, wherein a guide plate is arranged between the winding apparatuses and symmetric to the wire guide axis in the projection thereof and at a distance from the wire outlet, which guide plate has a guide path with two sides facing the winding apparatuses, a facing end of the slide guide body of the winding apparatuses sliding on this guide path.

8. The spring winding device according to claim 1, wherein the winding apparatuses are,arranged mirror-symmetric to the center plane.

9. The spring winding device according to claim 1, wherein the winding apparatuses are constructed mirror-symmetric to one another.

* * * * *